United States Patent [19]

Priebe

[11] 4,391,122

[45] Jul. 5, 1983

[54] COMBINED HYDRAULIC CLAMPING AND ROTATING SADDLE DEVICE ON FORGING PRESSES

[75] Inventor: Fritz Priebe, Duisburg, Fed. Rep. of Germany

[73] Assignee: SMS Schloemann-Siemag Aktiengesellschaft, Dusseldorf, Fed. Rep. of Germany

[21] Appl. No.: 278,681

[22] Filed: Jun. 29, 1981

[30] Foreign Application Priority Data

Jul. 11, 1980 [DE] Fed. Rep. of Germany ..... 3026295

[51] Int. Cl.[3] ..... B21J 13/02

[52] U.S. Cl. ..... 72/481; 72/462

[58] Field of Search ..... 72/462, 481, 453.09, 72/453.12, 453.01, 453.18

[56] References Cited

U.S. PATENT DOCUMENTS

| | | | |
|---|---|---|---|
| 3,158,046 | 11/1964 | Steinfort | 72/453.09 |
| 3,526,122 | 9/1970 | Hemingway | 72/462 |
| 3,683,667 | 8/1972 | Merriman | 72/462 |
| 3,896,652 | 7/1975 | Groos | 72/462 |
| 4,184,358 | 1/1980 | Gorlitsin | 72/462 |

FOREIGN PATENT DOCUMENTS

| | | | |
|---|---|---|---|
| 7143873 | 4/1972 | Fed. Rep. of Germany . | |
| 1277912 | 10/1961 | France | 72/481 |

*Primary Examiner*—Gene Crosby

*Attorney, Agent, or Firm*—Holman & Stern

[57] ABSTRACT

The moving crosshead of a forging press has quick-release clamping means for the upper press saddle comprising rotatable and retractable hammer-headed clamping rods, and means for rotating the upper saddle comprising a central rotatable hammer-headed rod engageable with and disengageable from a seat provided on the saddle and adapted to suspend the saddle while rotating it.

4 Claims, 7 Drawing Figures

COMBINED HYDRAULIC CLAMPING AND ROTATING SADDLE DEVICE ON FORGING PRESSES

FIELD OF THE INVENTION

The invention relates to an upper saddle clamping device for the movable crossheads of forging presses.

DESCRIPTION OF THE PRIOR ART

An upper saddle clamping device, which serves for rapidly locking the press tool to the movable crosshead of a forging press and in which hammer head rods are used for locking, is known from German Utility Model No. 7 143 873. In this case, the hammer head rods lock the tool by means of spring pressure, and unlock the tool from the crosshead by the pressure of hydraulic cylinders against the spring pressure. The hammer head rods are rotated simultaneously with their axial sliding for unlocking, by means of specially formed slide blocks. After the tool has been unlocked and the hammer head rods have been turned through an angle of 90°, the crosshead is raised, whereby the hammer head rods with their hammer heads are lifted out through slotted bores in the tool. Because of the use of hammer heads instead of the previously known wedges insertable manually into slots in the rods, the locking and unlocking of the tool are substantially accelerated. As the use of special slide blocks for turning the hammer heads during the unlocking procedure is relatively expensive, special hydraulic cylinders are now used, which by means of a lever rotate the hammer head rod after the unlocking process in order to release the tool from the crosshead. Special turning of the entire tool or upper saddle is not possible by means of this known device.

A tool holder for presses is known from U.S. Pat. No. 3,526,122 in which, with a very light upper saddle, only one retention rod is used, with the aid of which the upper saddle can be both locked and rotated through 90° after unlocking. However, in this case, after the retention rod has passed through a vertical bore in the upper saddle, it has to be locked under the latter by means of a wedge manually insertable into a slot in the retention rod. This device comprises two cylinders guided one in the other, the inner cylinder simultaneously acting as the piston of the outer cylinder, cup pressure springs, a hydraulic turning device and a special retention rod supported in ball bearings; it is costly and too complicated for rough operation.

BRIEF SUMMARY OF THE INVENTION

The object of the present invention is to provide a device for clamping the upper press saddle for heavier tools, which also allows the tool to be turned through 90°, is of simple and robust construction and operation, and in practice operates semi-automatically under remote control from the control desk without manual intervention.

According to the invention, a forging press is provided with:

(a) a plurality of vertical hammer-headed saddle-retaining rods mounted for rotation and longitudinal movement on the movable crosshead, for releasably clamping said upper saddle to said movable crosshead;

(b) a centrally disposed vertical hammer-headed saddle-rotating rod mounted for rotation on the movable crosshead with the hammer head of said rod at the lower end thereof projecting downwards from said crosshead;

(c) a receptacle provided on said upper saddle for receiving said hammer head of said saddle-rotating rod, which receptacle has a slot-like through aperture for vertical passage therethrough of said hammer head and a downwardly open slot-like seat transverse to said through aperture for receiving said hammer head and effecting rotational driving engagement of said hammer head with said upper saddle, a recess of a size corresponding to the length and height of the hammer head being provided directly below said seat and aperture whereby said hammer head is transferable from said aperture to said seat and vice versa by rotation within said recess;

(d) means for effecting rotation of said saddle-rotating rod and for effecting relative movement of said rod and said upper saddle in the longitudinal direction of said rod; and (e) means for effecting said rotation and longitudinal movement of said saddle-retaining rods.

In a preferred embodiment of the invention the press has four hammer head rods disposed parallel to the press axis and positioned to correspond to the spacing between the corners of the upper saddle tool plate, the hammer head rods being tightenable by cup springs against the underside of the crosshead or of the tool, thus locking the tool, and which unlock the tool by means of hydraulic cylinders slidable axially against the spring force, and in addition are rotatable by further hydraulic cylinders, and a hydraulic upper saddle rotating device disposed above the centre of the upper saddle is associated with the clamping device in the mobile crosshead, and consists of a hammer head rod which is supported vertically in the crosshead, is rotatable by means of a hydraulic cylinder, and projects by means of its hammer head from a protection plate disposed under the crosshead, and further consists of a cross-slotted ring disposed on the foot of the upper saddle, an axially through slot being provided as an insertion and withdrawal slot for the hammer head and a downwardly open slot located at 90° thereto being able to be coupled to the hammer head of the hammer head rod to act as a drive slot, the foot of the upper saddle being provided below the cross-slotted ring with a circular recess corresponding to the longitudinal dimensions and height of the hammer head.

By virtue of this combination of a known upper saddle clamping device and a rotating device for rotating the tool through 90°, both operations can be controlled from the press control desk without any manual intervention. The combination of the hammer head and the cross-slotted ring, which is fixed on the upper part of the foot of the upper saddle for the purpose of coupling the two parts together, by virtue of which it is possible to raise the upper press saddle from the lower press saddle and simultaneously rotate it by means of the hammer head rod, can be remotely controlled by means of hydraulic elements. Rotation is, obviously, only possible if the hammer head rods of the upper saddle clamping device have been previously unlocked from the tool and have been drawn back towards the movable crosshead. In this arrangement, the hammer head and cross-slotted ring represent simple components which are little affected by rough treatment during forging, and which require little maintenance.

In order to be able to fit an upsetting plate below the protection plate on the mobile crosshead, instead of the upper saddle, the hammer head rod of the rotating device is in two parts and these can be slid axially into each other against spring pressure, but cannot rotate relative to each other, the upper rod part being supported at its top and the lower rod part being supported at its bottom. The lower part of the hammer head rod can be pressed back against the spring pressure, into a recess provided in the protection plate, by an upsetting plate mounted on the protection plate, and thus does not hinder assembly of the upsetting plate.

Because of the fact that the lower rod part comprising the hammer head is supported at its bottom, the two-piece hammer head rod can sustain the total weight of the upper saddle during the rotation of the upper saddle through 90°.

BRIEF DESCRIPTION OF THE DRAWINGS

By way of example only, an embodiment of the invention is described hereinafter in detail with reference to the accompanying drawings, in which.

DETAILED DESCRIPTION

Figure 1:
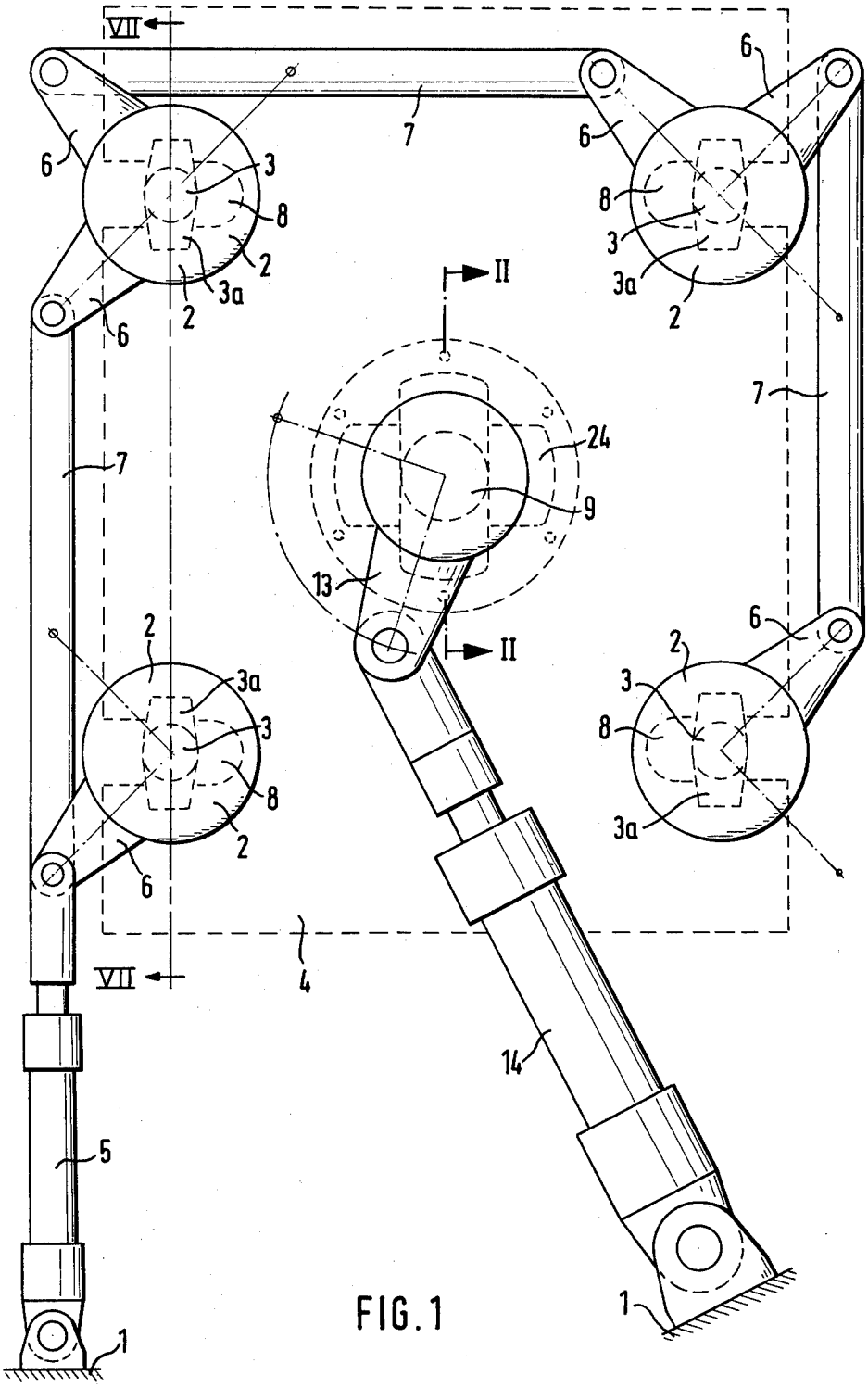
FIG. 1 is a plan view of a movable crosshead of a forging press, comprising hydraulic adjustment cylinders for hammer head rods in order to fix and turn the upper press saddle.

Four rotary drives 2 for rotating hammer head rods 3 are provided on the movable crosshead 1 of a forging press, for locking the upper saddle 4.

The illustrated press has a main press cylinder 30 mounted below floor level on a cylinder crosshead 31 connected by tie rods 32 to the cross head 1. The main press crosshead 33 is seated in a suitable foundation or bed 34 and carries the lower saddle 29 and guides 35 for the tie rods. The main press piston 36 acts against the crosshead 33, to move the crosshead 1.

Each hammer-head rod 3 is urged upwards by a stack of cup springs or spring washers such as Belleville springs 38 acting against the crosshead 1 or a member fast therewith. Associated with each rod is a hydraulic cylinder and piston unit 39 for pushing the rod down against the action of the springs. When raised by the springs the hammer heads 3*a* of the rods 3 clamp the upper saddle 4 to the crosshead 1.

To release the saddle the rods 3 are lowered by the said cylinders and are rotated.

Forms of spring and hydraulic cylinder arrangements for hammer head rods are shown in German Utility Model Specification No. 7143873 and U.S. Pat. No. 3,526,122 which disclosures are incorporated herein by reference. FIG. 1 shows the clamped position of the upper saddle 4. For release purposes, a hydraulic cylinder 5 hinged to the crosshead 1 rotates the hammer head rods 3 through 90° by way of levers 6 and connecting rods or links 7 so that the hammer heads 3 lie in the insertion and removal slots 8 of the upper saddle foot 4*a*.

Figure 2:
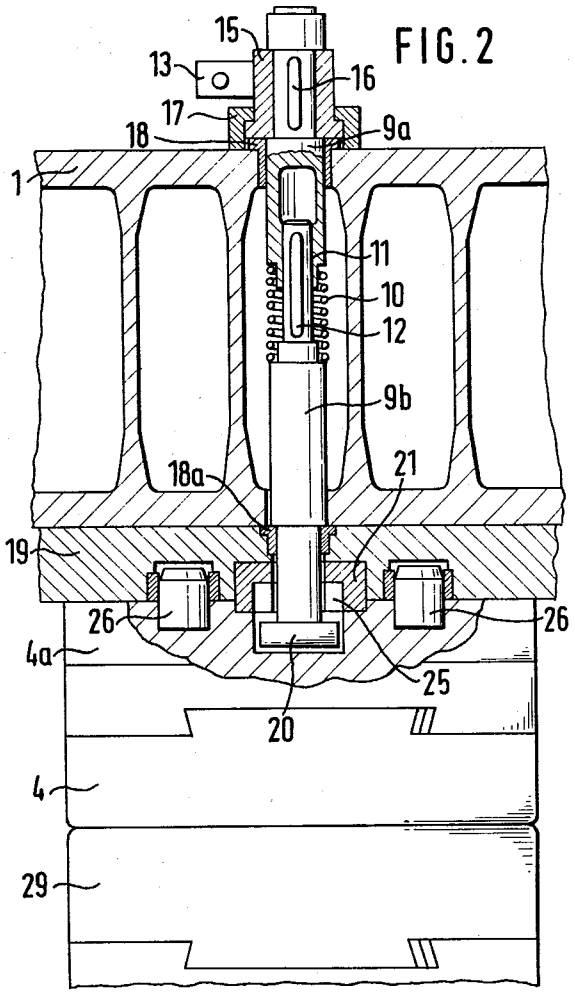
FIG. 2 is a partial longitudinal cross-section taken on the line II—II of FIG. 1 along the axis of the forging press, showing a hammer head rod disposed centrally in the crosshead, with clamping between the crosshead and protection plate and between the crosshead and upper saddle having been released as a prerequisite for rotation.

A two-part telescopic hammer head rod 9 with its upper part 9*a* supported on the crosshead 1 is disposed in the center or on the press axis (FIG. 2). The lower part 9*b* is slidable in a bore 11 in the upper part 9*a* against the pressure of a compression spring 10, the two parts being made non-rotatable relative to each other by means of a key 12.

The upper part 9*a* of the hammer head rod 9 is provided with a lateral lever 13, with which, as a rotary drive, there engages the piston rod of a hydraulic cylinder 14 hinged to the crosshead 1 (FIG. 1). The lever 13 is fixed onto a bushing 15, which is connected in a non-rotatable manner to the upper rod part 9*a* by means of a key 16 and is retained on the crosshead 1 by means of a screw collar ring 17. The upper rod part 9*a* is supported in a bearing bushing 18 inserted in a bore in the crosshead 1.

The lower part 9*b* of the hammer head rod 9 is displaced downwards and is supported in a lower two-part bearing bushing 18*a*, inserted in a protection plate 19 disposed below the crosshead 1. At its lower end it has a hammer head 20 which projects through a slotted ring 21 and into a circular recess 22 in the upper saddle foot 4*a*. The recess 22 has a depth which is equal at least to the height of the hammer head 20.

Figure 4:
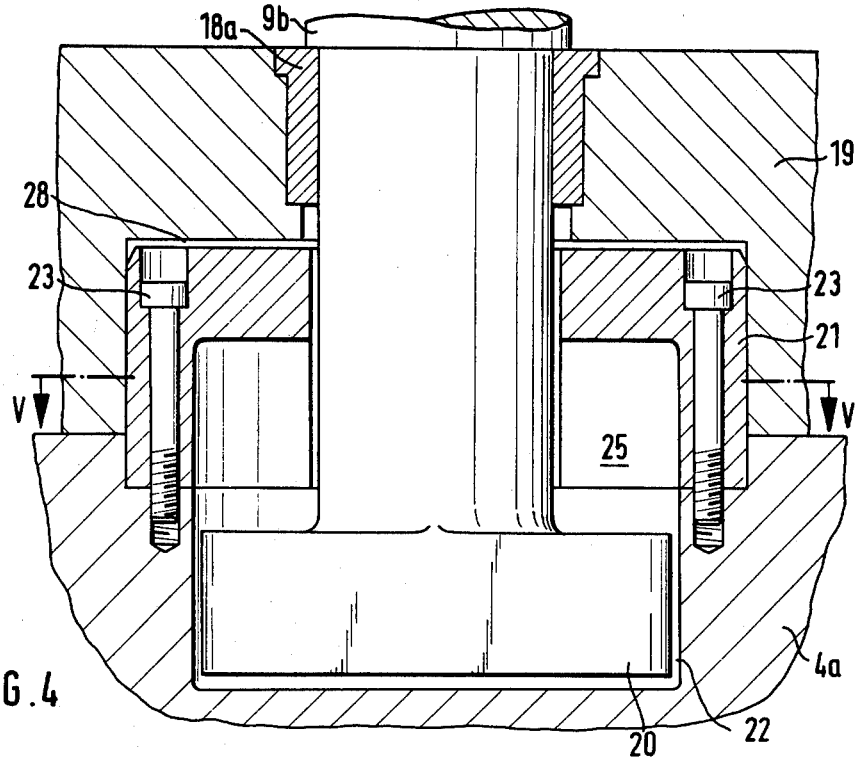
FIG. 4 is a cross-sectional view on an enlarged scale through the protection plate and saddle foot of the upper saddle, showing the hammer head and cross-slotted ring.
Figure 5:
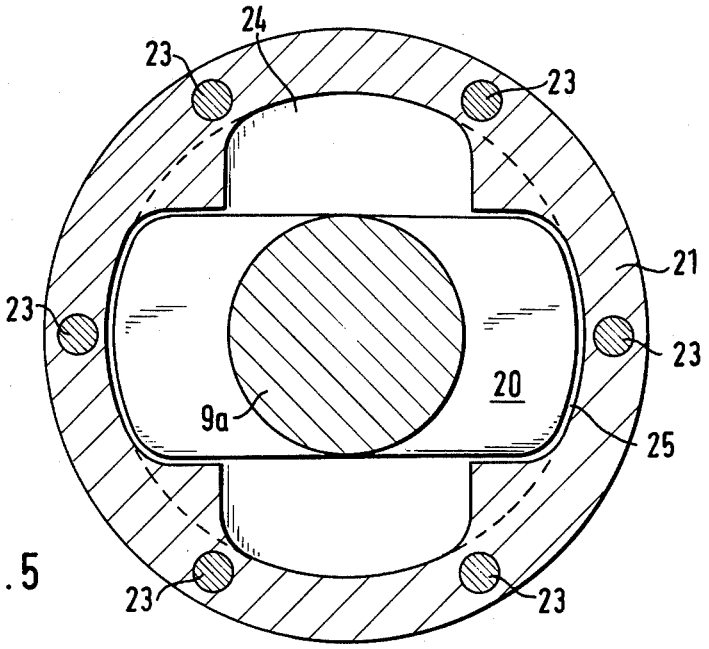
FIG. 5 is a cross-section through the cross-slotted ring and hammer head rod taken on the line V—V of FIG. 4.
Figure 6:
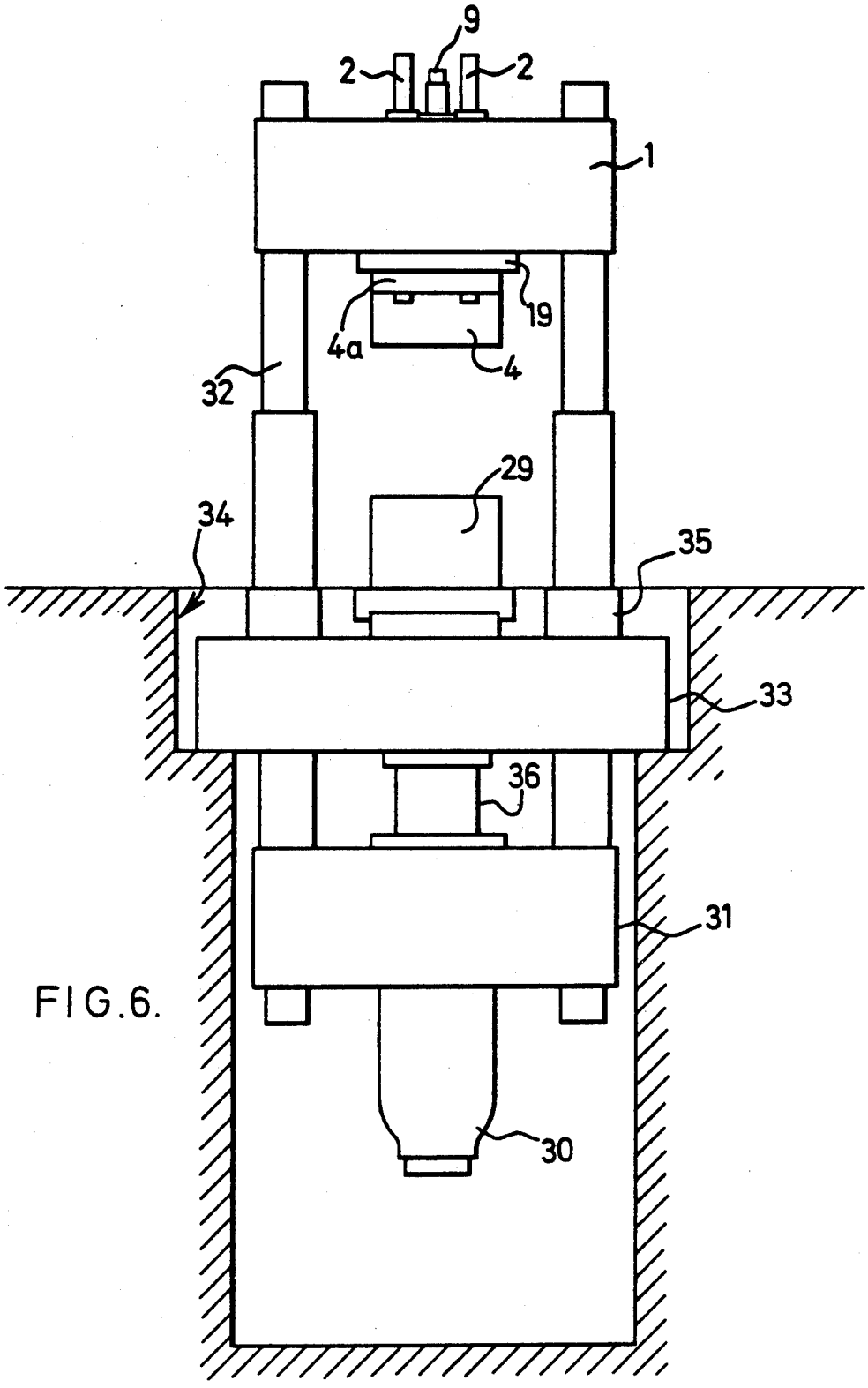
FIG. 6 is a general view of a press.
Figure 7:
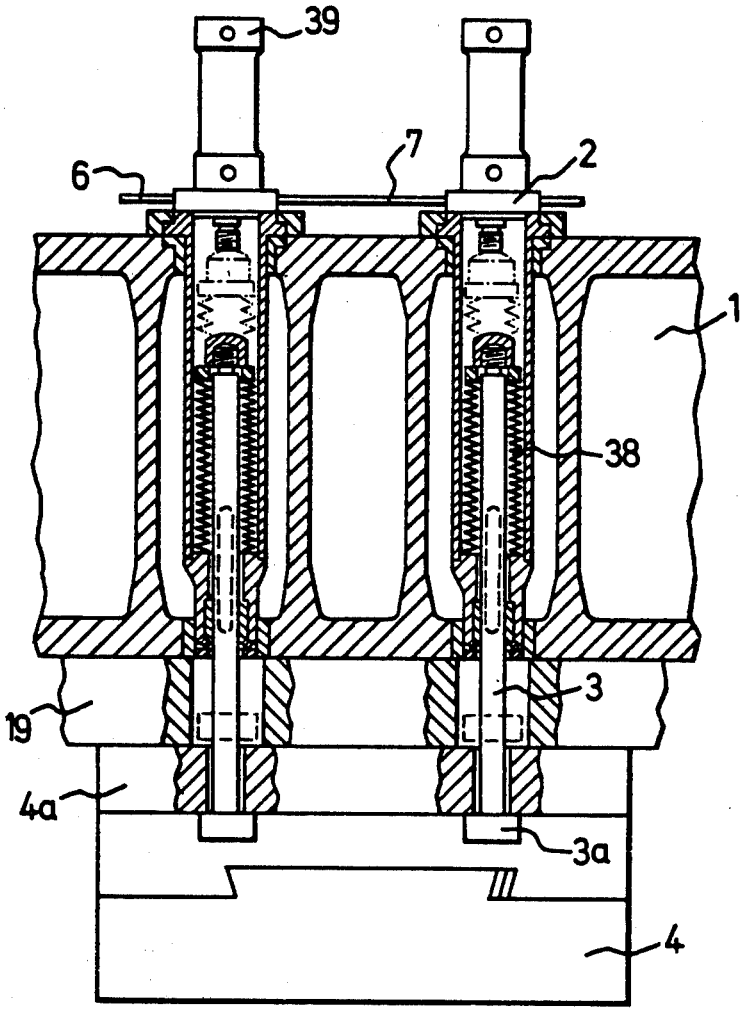
FIG. 7 is a partial cross-section taken on line VII—VII of FIG. 1.

The ring 21 (FIGS. 4 and 5) is fixed by screws 23 to the top of the upper saddle foot 4, and is provided with a through slot 24 for the insertion and removal of the hammer head 20, and with a coupling or drive slot 25 for the hammer head 20 disposed at 90° to the slot 24, but which does not pass completely through the ring and is open downwards.

When the upper saddle 4 is locked to the protection plate 19 or crosshead 1 by means of the hammer head rods 3, the upper saddle 4 is centred by means of two centering pins 26 provided in the upper saddle foot 4*a* to the right and left of the press axis, which enter two bores 27 in the protection plate 19. Two further bores 27, not shown, are provided in the protection plate 19 at positions offset by 90° from the first. When the upper saddle 4 is in its locked state, the cross-slotted ring 21 projects into a recess 28 in the protection plate 19 corresponding to the external dimensions of the cross-slotted ring 21.

The operation of the described hydraulic upper saddle clamping and rotating device is as follows:

1. Installing the upper saddle

The hammer head rods 3 together with the hammer heads 3*a* are rotated to positions parallel to the slots 8 in the upper saddle foot 4*a*, by means of the rotary drives 2 and hydraulic cylinder 5. The upper saddle 4 lies on a lower saddle 29 (FIGS. 2 and 3) under the crosshead 1. The crosshead 1 moves downwards until the protection plate 19 lies on the upper saddle foot 4*a*. The hammer head rods 3 are pressed downwards against the pressure of cup springs 38 by means of hydraulic cyinders 39 acting in the axial direction of the hammer head rods 3, until they are about 30 mm below the underside of the upper saddle foot 4*a*. The four rotary drives 2 are then rotated through 90°, so that the hammer heads 3*a* lie at 90° to the slots 8. The axially acting hydraulic cylinders 39 are then discharged and the cup springs 38 clamp the upper saddle 4 against the protection plate 19.

The upper saddle is removed by the reverse series of operations.

2. Rotation of the upper saddle

In order to rotate the upper saddle 4, the upper saddle 4 is first released from the clamping device, in the manner heretofore described. The upper saddle 4 then lies on the lower saddle 29, and the protection plate 19 on the crosshead 1 is lowered onto the upper saddle foot 4*a* (FIG. 2).

Figure 3:
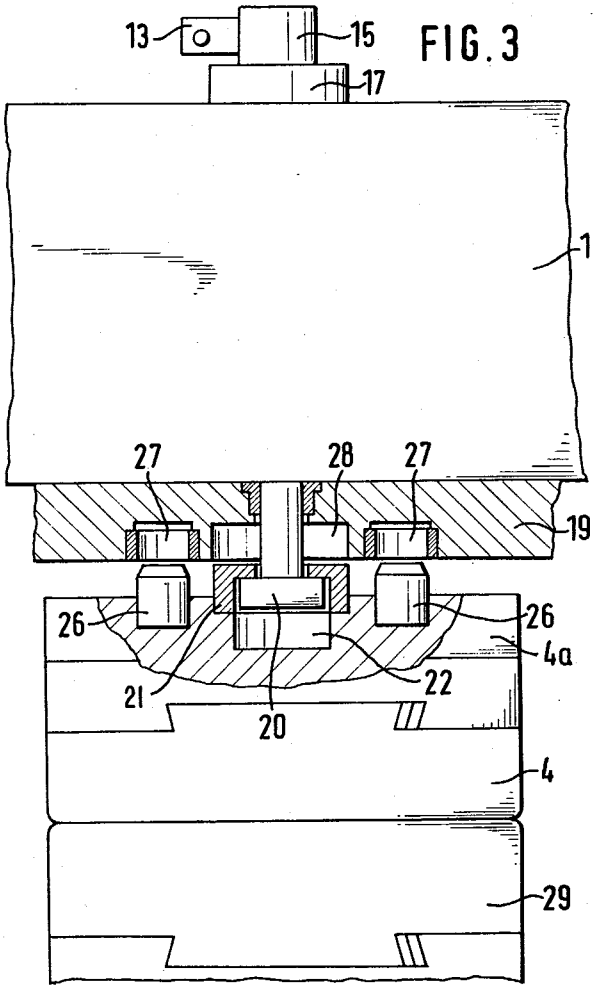
FIG. 3 is a view similar to FIG. 2, but showing the upper saddle separated from the protection plate and crosshead in the coupling stage, in the position for rotating the upper saddle with the crosshead raised.

The hammer head 20 of the hammer head rod 9 of the rotating device is led through the through slot 24 until it lies in the recess 22 in the upper saddle foot 4*a*, and is then rotated through 90° by means of the hydraulic cylinder 14 so that the hammer head 20 is now exactly below the drive or coupling slot 25. The crosshead 1 is now raised until the centering pins 26 have completely emerged from the bores 27 in the protection plate 19; during this, the hammer head 20 slides into the drive or coupling slot 25 in the cross-slotted ring 21 (FIG. 3). The hammer head rod 9 is then rotated through 90° by means of the hydraulic cylinder 14 hinged to the crosshead 1. By this means, the upper saddle 4, which rests lightly on the lower saddle 29, is rotated by the hammer head 20 engaged in the coupling slot 25.

If the crosshead 1 is raised still further, the entire upper saddle is lifted off the lower saddle 25 by means of the hammer head rod 9 and its hammer head 20. If the hydraulic cylinder 14 is now operated, the upper saddle 4 can be rotated through 90° in the air.

If an upsetting plate (not shown) is to be fitted under the protection plate 19 of the crosshead, the two-part hammer head rod 9 of the rotating device is telescoped and the hammer head 20 disappears into the recess 28 of the protection plate 19, which otherwise receives the cross-slotted ring 21.

I claim:

1. In a forging press having a movable crosshead and an upper press saddle carried by said crosshead; the improvement comprising the combination of:

(a) a plurality of vertical hammer-headed saddle-retaining rods mounted for rotation and longitudinal movement on the movable crosshead, for releasably clamping said upper saddle to said movable crosshead;

(b) a centrally disposed vertical hammer-headed saddle-rotating rod mounted for rotation on the movable crosshead with the hammer head of said rod at the lower end thereof projecting downwardy from said crosshead;

(c) a receptacle provided on said upper saddle for receiving said hammer head of said saddle-rotating rod, which receptacle has a slot-like through aperture for vertical passage therethrough of said hammer head and a downwardly open slot-like seat transverse to said through aperture for receiving said hammer head and effecting rotational driving engagement of said hammer head with said upper saddle, a recess of a size corresponding to the length and height of the hammer head being provided directly below said seat and aperture whereby said hammer head is transferrable from said aperture to said seat and vice versa by rotation within said recess;

(d) means for effecting rotation of said saddle-rotating rod and for effecting relative movement of said rod and said upper saddle in the longitudinal direction of said rod; and (e) means for effecting said rotation and longitudinal movement of said saddle-retaining rods.

2. The press of claim 1 wherein said saddle-rotating rod is telescopic with telescopic rod parts coupled for rotation as one, and wherein means are provided for biasing said telescopic saddle-rotating rod to the telescopically extended position thereof.

3. The press of claim 2 wherein said telescopic rod comprises an upper part mounted for rotation in said crosshead and provided with a driving connection for rotation of the rod, and a lower part mounted for rotation and longitudinal sliding relative to said crosshead and provided with said hammer head at its lower end, and wherein respective supports are provided for said upper and lower parts, at upper and lower regions thereof respectively.

4. A hydraulic upper saddle clamping and rotative device for a forging press having a movable crosshead, and a protective plate and substantially rectangular upper press saddle carried by the movable crosshead comprising four hammer head rods disposed parallel to the press axis and positioned to correspond to the spacing between the corners of the upper saddle, the hammer head rods being movable axially between upper and lower positions in which they respectively allow and prevent movement of said saddle and being rotatable for engagement with and disengagement from the saddle, cup springs urging said rods towards the underside of the crosshead for raising the rods when rotated to a disengaged position and for clamping said saddle when rotated to an engaged position, hydraulic cylinder drive means mounted on the crosshead coupled to the rods for rotating them, and hydraulic cylinder drive means coupled to the rods for moving them axially against the force of said cup springs, and a hydraulic upper saddle rotating device disposed above the center of the upper saddle comprising a hammer head rod rotatably supported vertically in the crosshead and projecting by means of its hammer head from the protection plate disposed under the crosshead, hydraulic cylinder means mounted on the crosshead coupled to said saddle rotating rod for rotating it, a cross-slotted ring disposed on the upper saddle, an axially through slot being provided in said ring as an insertion and withdrawal slot for the hammer head and a downwardly open slot in said ring located at 90° to said through slot to be removably coupled to the hammer head of the hammer head rod to function as a drive slot, and the upper saddle being provided below the cross-slotted ring with a circular recess corresponding to the longitudinal dimensions and height of the hammer head.

* * * * *